US008770422B2

(12) United States Patent
Cantin et al.

(10) Patent No.: US 8,770,422 B2
(45) Date of Patent: Jul. 8, 2014

(54) ADAPTER PLATE FOR A CONTAINER ASSEMBLY

(75) Inventors: Philip T. Cantin, Guildhall, VT (US); Rick A. Cochran, St. Johnsbury, VT (US); Justin M. White, West Danville, VT (US)

(73) Assignee: Mobile Medical International Corporation, St. Johnsbury, VT (US)

( * ) Notice: Subject to any disclaimer, the term of this patent is extended or adjusted under 35 U.S.C. 154(b) by 14 days.

(21) Appl. No.: 13/209,080

(22) Filed: Aug. 12, 2011

(65) Prior Publication Data

US 2012/0037622 A1 Feb. 16, 2012

Related U.S. Application Data

(60) Provisional application No. 61/373,473, filed on Aug. 13, 2010.

(51) Int. Cl.

*B65D 21/02* (2006.01)
*B65D 19/44* (2006.01)
*B65D 77/04* (2006.01)

(52) U.S. Cl.

CPC ..... *B65D 19/44* (2013.01); *B65D 2519/00338* (2013.01); *B65D 2519/00343* (2013.01); *B65D 2519/00348* (2013.01); *B65D 77/0466* (2013.01)

USPC ..... 220/23.83; 220/1.5; 206/527; 206/386; 206/595; 206/54

(58) Field of Classification Search

CPC ..... B65D 2519/00328; B65D 2519/00333; B65D 2519/00338; B65D 2519/00343; B65D 2519/00348; B65D 77/0466; B65D 19/44

USPC ..... 220/1.5, 23.83; 410/54, 77, 84; 416/244 R; 248/346.03; 206/527

See application file for complete search history.

(56) References Cited

U.S. PATENT DOCUMENTS 1,408,908 A 3/1922 Roth
1,438,640 A 12/1922 Flack et al.

(Continued)

FOREIGN PATENT DOCUMENTS

DE 33 29 620 A1 3/1985
EP 0 604 765 A1 7/1994

(Continued)

OTHER PUBLICATIONS

CMCI Products Web Page (http://www.cmci.com/Quadcons.aspx); Apr. 10, 2010.*

(Continued)

*Primary Examiner* — Andrew Perreault
*Assistant Examiner* — James M Van Buskirk
(74) *Attorney, Agent, or Firm* — K&L Gates, LLP

(57) ABSTRACT

An adapter plate for a container unit that can be coupled to at an additional container unit to form an intermodal container having the approximate dimensions of a standard ISO container. The intermodal container can be handled by a medium tactical vehicle with a load handling system. The container unit has first and second substantially parallel corner posts, an upper frame support extending between first ends of the corner posts, a lower frame support extending between second ends of the corner posts, and a connection block disposed adjacent the second ends of the corner posts. The adapter plate is disposed adjacent the connection block. A proximal end of the adapter plate is connected to the connection block and positioned generally flush with an outer facing surface of the connection block. A distal end of the adapter is angled to connect to an outer surface of the lower frame support.

17 Claims, 16 Drawing Sheets

(56) References Cited

U.S. PATENT DOCUMENTS

| | | | | |
|---|---|---|---|---|
| 1,578,390 | A | 3/1926 | Brown | |
| 1,640,931 | A | 8/1927 | Gettner | |
| 1,675,912 | A | 7/1928 | Sawyer | |
| 2,052,723 | A | 9/1936 | Richards | |
| 2,167,557 | A | 7/1939 | Stout | |
| 2,395,691 | A | 2/1946 | Smith | |
| 2,636,773 | A | 4/1953 | Tassel | |
| 2,670,504 | A | 3/1954 | Peterson | |
| 2,765,499 | A | 10/1956 | Couse | |
| 2,939,467 | A | 6/1960 | Meyer et al. | |
| 3,001,662 | A * | 9/1961 | Herpich | 220/1.5 |
| 3,004,592 | A | 10/1961 | Norton | |
| 3,048,147 | A | 8/1962 | McKean | |
| 3,061,133 | A * | 10/1962 | Reynolds | 220/1.5 |
| 3,205,629 | A | 9/1965 | Rumley et al. | |
| 3,217,366 | A | 11/1965 | Wenger | |
| 3,397,006 | A | 8/1968 | Grant | |
| 3,461,633 | A | 8/1969 | Ziegelman et al. | |
| 3,463,538 | A | 8/1969 | Koon | |
| 3,511,529 | A | 5/1970 | Cutsinger | |
| 3,526,066 | A | 9/1970 | Hagar et al. | |
| 3,719,386 | A | 3/1973 | Puckett et al. | |
| 3,776,169 | A * | 12/1973 | Strecker | 410/77 |
| 3,792,667 | A | 2/1974 | Paton | |
| 3,835,600 | A | 9/1974 | Padula et al. | |
| 3,898,779 | A | 8/1975 | Tracy | |
| 4,043,288 | A | 8/1977 | Vulovic | |
| 4,258,511 | A | 3/1981 | Strain | |
| 4,267,679 | A | 5/1981 | Thompson | |
| 4,349,108 | A | 9/1982 | Sharpe | |
| 4,510,663 | A | 4/1985 | Friesz | |
| 4,689,924 | A | 9/1987 | Jurgensen | |
| 4,813,542 | A * | 3/1989 | Thompson et al. | 206/504 |
| 4,918,898 | A | 4/1990 | McLeod | |
| 4,955,661 | A | 9/1990 | Mattice | |
| 4,979,532 | A | 12/1990 | Johansson et al. | |
| 5,018,322 | A | 5/1991 | Fujita | |
| 5,038,517 | A | 8/1991 | Talbott | |
| 5,062,174 | A | 11/1991 | DaSalvo | |
| 5,170,901 | A | 12/1992 | Bersani | |
| 5,185,973 | A | 2/1993 | Oldani | |
| 5,237,784 | A | 8/1993 | Ros | |
| 5,345,730 | A | 9/1994 | Jurgensen | |
| 5,353,557 | A | 10/1994 | Lerner et al. | |
| 5,440,773 | A | 8/1995 | Lentini | |
| 5,478,129 | A | 12/1995 | Goto et al. | |
| 5,597,028 | A | 1/1997 | Rolf et al. | |
| 5,667,267 | A | 9/1997 | Talucci | |
| 5,706,616 | A | 1/1998 | Fernandez | |
| 5,706,846 | A | 1/1998 | Sutton | |
| 5,716,090 | A | 2/1998 | Chang et al. | |
| 5,732,839 | A | 3/1998 | Schimmang et al. | |
| 5,761,854 | A | 6/1998 | Johnson et al. | |
| 5,894,698 | A | 4/1999 | Dewald, Jr. et al. | |
| 5,934,726 | A | 8/1999 | Bossett | |
| 5,966,956 | A | 10/1999 | Morris et al. | |
| 6,009,587 | A | 1/2000 | Beeman | |
| 6,070,925 | A | 6/2000 | Moldofsky | |
| 6,152,520 | A | 11/2000 | Gardner | |
| 6,176,045 | B1 | 1/2001 | McManus et al. | |
| 6,223,479 | B1 | 5/2001 | Stockli | |
| 6,345,471 | B1 | 2/2002 | Gyllenhammar | |
| 6,363,664 | B1 | 4/2002 | Brutsaert | |
| 6,494,334 | B1 | 12/2002 | Cheng | |
| 6,536,363 | B1 | 3/2003 | Carlberg | |
| 6,712,414 | B2 | 3/2004 | Morrow | |
| 6,772,563 | B2 | 8/2004 | Kuhn | |
| 6,971,707 | B1 | 12/2005 | Mullan | |
| 7,017,975 | B2 | 3/2006 | Parmer | |
| 7,117,645 | B2 | 10/2006 | Bzorgi | |
| 7,178,857 | B2 | 2/2007 | Williams | |
| 7,246,647 | B2 | 7/2007 | Mullet et al. | |
| 7,252,468 | B2 * | 8/2007 | Moore et al. | 410/46 |
| 7,418,802 | B2 | 9/2008 | Sarine et al. | |
| 7,712,813 | B2 | 5/2010 | Di Franco | |
| 7,717,290 | B2 | 5/2010 | Gerding | |
| 7,726,496 | B2 | 6/2010 | Heinrichs et al. | |
| 7,784,845 | B2 | 8/2010 | Kim et al. | |
| 7,874,107 | B1 | 1/2011 | Medley et al. | |
| 7,905,241 | B2 | 3/2011 | DeVries et al. | |
| 7,946,333 | B1 | 5/2011 | Zapata | |
| 7,966,775 | B2 | 6/2011 | Medley | |
| 7,971,713 | B2 | 7/2011 | Kim | |
| 8,166,715 | B2 | 5/2012 | De Azambuja | |
| 8,245,455 | B2 | 8/2012 | Medley | |
| 2001/0008059 | A1 | 7/2001 | McManus et al. | |
| 2002/0007602 | A1 | 1/2002 | Corcoran | |
| 2002/0023393 | A1 | 2/2002 | McManus | |
| 2002/0179598 | A1 | 12/2002 | Kuhn | |
| 2003/0024928 | A1 | 2/2003 | Serden | |
| 2003/0029099 | A1 | 2/2003 | Torata | |
| 2003/0115808 | A1 | 6/2003 | Morrow | |
| 2003/0213185 | A1 | 11/2003 | Findley | |
| 2004/0083671 | A1 | 5/2004 | Johnson et al. | |
| 2004/0194401 | A1 | 10/2004 | Smith et al. | |
| 2005/0072062 | A1 | 4/2005 | Aust et al. | |
| 2005/0103791 | A1 * | 5/2005 | Gerding | 220/629 |
| 2005/0120639 | A1 | 6/2005 | Bucher et al. | |
| 2006/0055193 | A1 | 3/2006 | Colborne | |
| 2006/0081628 | A1 | 4/2006 | Myers et al. | |
| 2006/0113813 | A1 | 6/2006 | Hicks | |
| 2006/0254159 | A1 | 11/2006 | Trautman et al. | |
| 2007/0107321 | A1 | 5/2007 | Sarine et al. | |
| 2007/0108795 | A1 | 5/2007 | Reynard | |
| 2007/0126209 | A1 | 6/2007 | Wolfe | |
| 2008/0134589 | A1 | 6/2008 | Abrams et al. | |
| 2008/0149156 | A1 | 6/2008 | Serden et al. | |
| 2009/0044460 | A1 | 2/2009 | Medley | |
| 2009/0217600 | A1 | 9/2009 | De Azambuja | |
| 2010/0011676 | A1 | 1/2010 | Barry | |
| 2010/0024316 | A1 | 2/2010 | Pope | |
| 2010/0024317 | A1 | 2/2010 | Pope | |
| 2010/0024319 | A1 | 2/2010 | Pope | |
| 2010/0050540 | A1 | 3/2010 | Bucher et al. | |
| 2010/0319742 | A1 | 12/2010 | Prusmack | |
| 2011/0132421 | A1 | 6/2011 | Dolsby et al. | |
| 2011/0210577 | A1 | 9/2011 | Cochran et al. | |
| 2011/0297675 | A1 | 12/2011 | Johnson et al. | |
| 2012/0006369 | A1 | 1/2012 | Cantin et al. | |
| 2012/0037198 | A1 | 2/2012 | Cantin et al. | |
| 2012/0037621 | A1 | 2/2012 | Cantin et al. | |
| 2012/0151851 | A1 | 6/2012 | Cantin et al. | |
| 2012/0248818 | A1 | 10/2012 | Cochran et al. | |

FOREIGN PATENT DOCUMENTS

| | | | |
|---|---|---|---|
| GB | 2476102 | | 6/2011 |
| JP | 2-261174 | A | 10/1990 |
| JP | 5-018008 | A | 1/1993 |
| JP | 5-033395 | A | 2/1993 |
| WO | 2012/135809 | A1 | 10/2012 |

OTHER PUBLICATIONS

International Application No. PCT/US2012/031796, International Search Report & Written Opinion mailed on Aug. 17, 2012, 4 Pages.

International Search Report & Written Opinion for International Application No. PCT/US2013/032996 mailed Jun. 5, 2013 (15 pages).

* cited by examiner

ADAPTER PLATE FOR A CONTAINER ASSEMBLY

The present application claims the benefit of U.S. Provisional Patent Application 61/373,473; filed Aug. 13, 2010.

STATEMENT REGARDING FEDERALLY SPONSORED RESEARCH OR DEVELOPMENT

The work resulting in this invention was supported in part by the U.S. Army Medical Material Development Agency (USAMMDA) under Contract No. W81XWH-08-C-0060. The U.S. Government therefore has certain rights in the invention.

BACKGROUND

1. Field of Invention

The present application relates to ISO containers and container units coupled to form an ISO container, and more particularly to an adapter plate for ISO containers and container units.

2. Related Art

Standard (International Organization for Standardization) shipping containers are capable of being formed by using multiple container units or modules. Standard ISO shipping containers having three equal sized modules are known. Each module is known as a tri-con container. The three tri-con containers, when coupled together, have generally the size and shape of a standard ISO shipping container. The standard size for such containers is about 8 feet tall, 8 feet wide, and 20 feet long. The tri-con containers may be coupled together by coupling devices that extend through mating, locking holes on corner posts of the containers. The resulting assembled container may be shipped by commercial means, such as by truck, railway, boat or aircraft, including military aircraft. If need be, such a tri-con container may be deployed at a remote location.

Expandable shelters are known which can be inflated at a remote location for medical uses, temporary housing, disaster recovery, meeting space, office space or laboratory space. These shelters typically include a skin or fabric which may rest on a frame. Such a frame may be formed from an air beam structure. Air beam structures typically comprise tubes which have a desired size and shape and which are inflated with air to form a relatively rigid structure. Prior to deployment, these shelters may be rolled up and stowed in relatively small space.

SUMMARY

In accordance with one aspect of the present invention, a container unit is provided. The container unit can be coupled to at least one additional container unit to form an intermodal container having the approximate dimensions of a standard ISO container. The intermodal container can be handled by a medium tactical vehicle with a load handling system. The container unit comprises first and second substantially parallel corner posts. The container unit also comprises an upper frame support extending between first ends of the corner posts. The container unit further comprises a lower frame support extending between second ends of the corner posts. The container unit additionally comprises first and second connection blocks each disposed adjacent the second ends of the corner posts. The container unit also comprises first and second adapter plates each disposed adjacent one of the connection blocks. A proximal end of the adapter plate is connected to the connection block and positioned generally flush with an outer facing surface of the connection block. A distal end of the adapter is angled to connect to an outer surface of the lower frame support.

In accordance with another aspect of the present invention, an adapter plate for a container unit is provided. The adapter plate can be coupled to at least one additional container unit to form an intermodal container having the approximate dimensions of a standard ISO container. The intermodal container can be handled by a medium tactical vehicle with a load handling system. The container unit has first and second substantially parallel corner posts. The container unit also has an upper frame support extending between first ends of the corner posts. The container unit additional has a lower frame support extending between second ends of the corner posts. The container unit also has a connection block disposed adjacent the second ends of the corner posts. The adapter plate is disposed adjacent the connection block. A proximal end of the adapter plate is connected to the connection block and positioned generally flush with an outer facing surface of the connection block. A distal end of the adapter is angled to connect to an outer surface of the lower frame support.

BRIEF DESCRIPTION OF DRAWINGS

The accompanying drawings are not intended to be drawn to scale. In the drawings, each identical or nearly identical component that is illustrated in various figures is represented by a like descriptor. For purposes of clarity, not every component may be labeled in every drawing.

The advantages and features of this invention will be more clearly appreciated from the following detailed description, when taken in conjunction with the accompanying drawings, in which.

DETAILED DESCRIPTION

Figure 1:
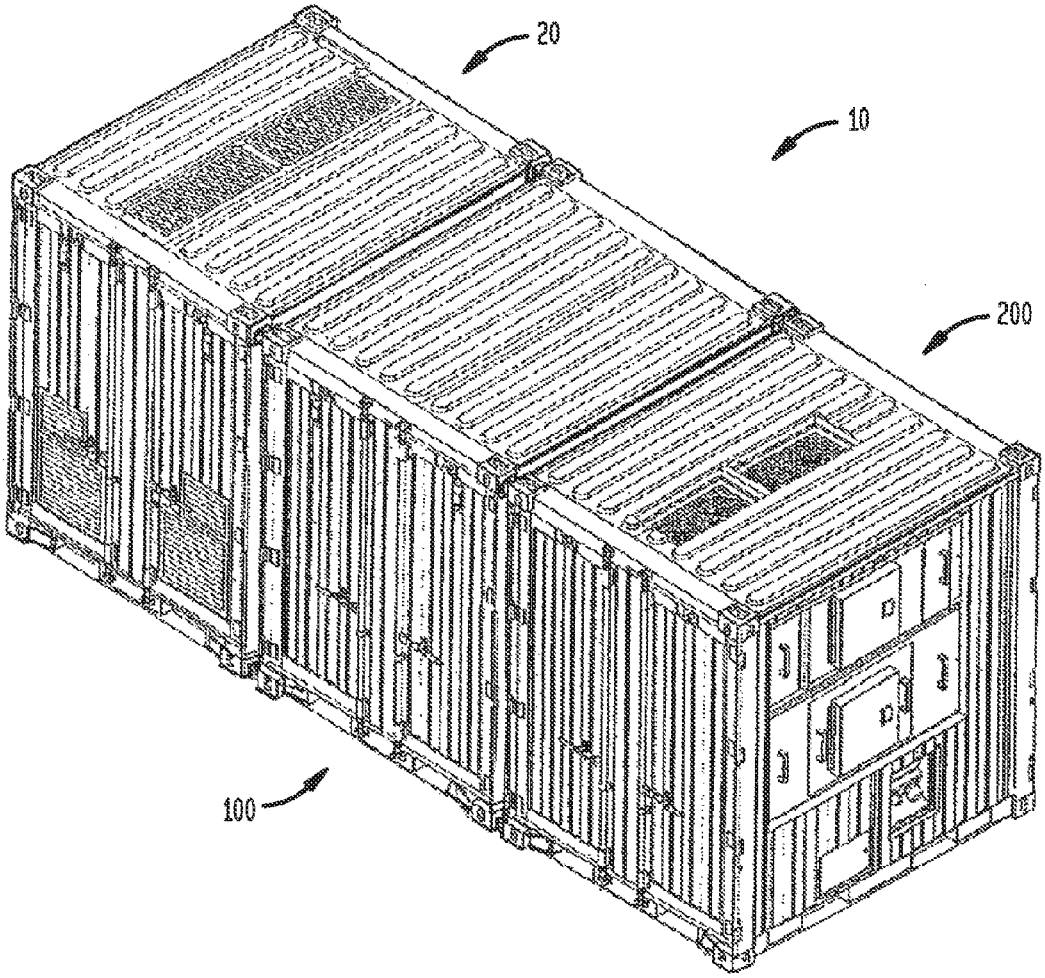
FIG. 1 is a perspective view of three tri-con containers assembled together to form an ISO shipping container for transport.
Figure 2:
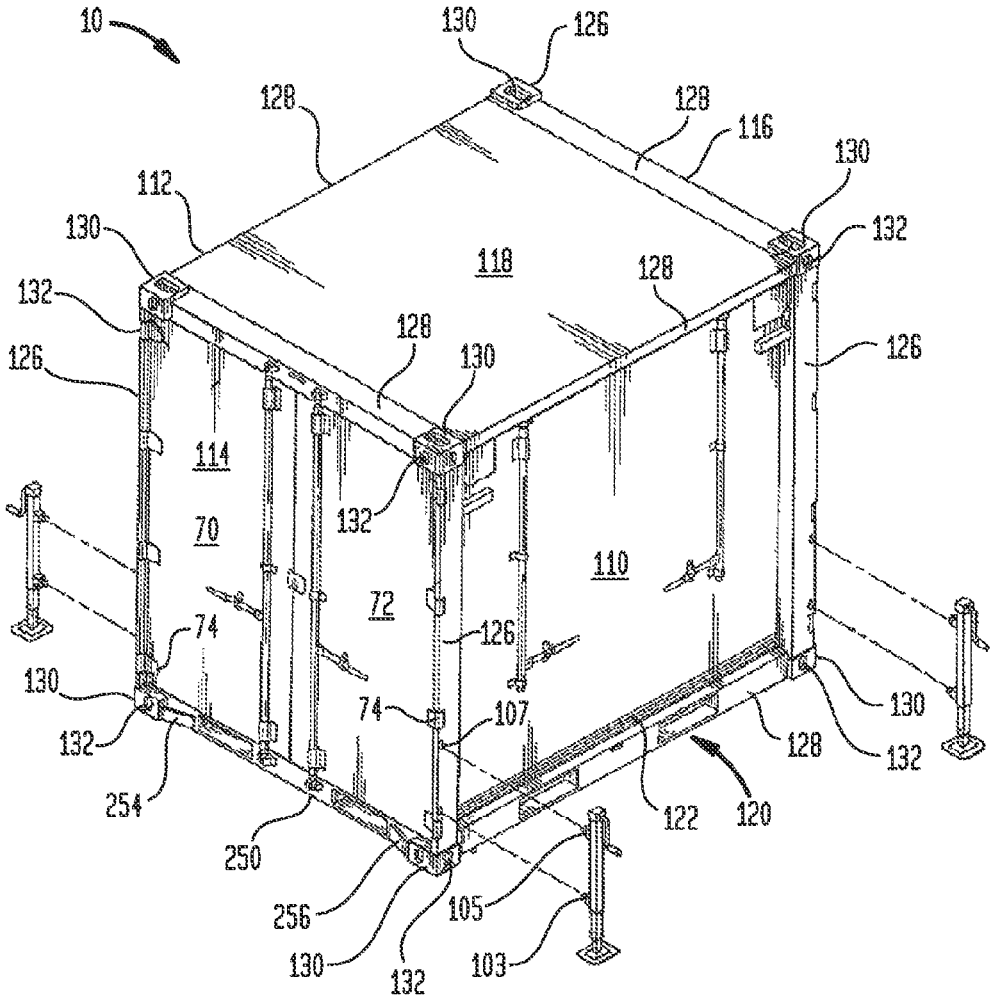
FIG. 2 is a perspective view of a hard walled shelter tri-con container.

In the present invention, typical tri-con containers may be configured to be used with inflatable shelters. Three such tri-con containers, or container units or modules, may be coupled together for shipping and storage. In this assembled state, the three tri-con containers have the size and shape of a typical ISO shipping container, and form a unitary structure. That is, they have a rectangular shape and a size of about 8 feet×8 feet×20 feet.

In one aspect of this invention, one of the tri-con containers includes four corner posts, and four sidewalls extending between adjacent corner posts as well as a top wall and a bottom wall. At least one and typically two of the sidewalls are hinged at their bottom edge which permits these sidewalls to be pivoted downwardly to form a ramp. Typically, for two walls that pivot downwardly, they are disposed opposite one another, although they need not be. In one embodiment of this aspect, a softwalled, expandable shelter is associated with each of these sidewalls. These softwalled, expandable shelters may be strapped to the inside surface of the sidewall, prior to deployment. In another embodiment, the shelters, prior to deployment, are nested one above the other when the sidewalls are raised to their vertical position.

In one embodiment, each of the softwalled, expandable shelters includes an air beam structure with a skin or layer of fabric placed thereover. A vestibule or portico is disposed at one end of the shelter. The vestibule or portico is attachable to a fabric connector surrounding an opening in the tri-con containers formed by lowering the sidewall. The vestibule or portico may include an attachment device, such as a zipper, which mates with a zipper on the fabric connector to attach the vestibule or portico to the tri-con container. In another embodiment, the softwalled, expandable shelter may include an inner lining, such as an antimicrobial lining, which may also be attached to a layer of such lining in the fabric connector.

In another aspect, two softwalled, expandable shelters may be provided extending from opposite sides of a tri-con container. The pivoted sidewalls provide a transition from a ground surface to an interior of the tri-con container.

In another aspect of the invention, a third side of the tri-con container, which is intermediate the first two sides and extends perpendicular thereto, may also be formed with a ramp and a fabric connector. Another shelter system, such as an expandable hard walled ISO shelter, or another softwalled, expandable shelter, may be attached to the tri-con container along the third side. This attachment may be similar to the attachment of the other softwalled, expandable shelters, such as by using a vestibule or portico and a fabric connector surrounding the opening to the tri-con container on the third side.

In yet another aspect of the invention, another tri-con container may include a mechanical module which provides electrical and environmental support for the softwalled, expandable shelters. This second tri-con container could include heating and air conditioning systems, air filters, humidity control, electrical power and a fuel tank for powering the electrical generator and the heating and air conditioning systems.

In yet another aspect of the invention, a third tri-con container may be provided having the same size and shape as the first two tri-con containers. This third tri-con container may include an additional mechanical module for servicing the expandable ISO shelter, or a third softwalled, expandable shelter. In another embodiment, the third tri-con container may provide storage for other supplies to be used in conjunction with the softwalled, expandable shelters, or with the expandable ISO shelter.

In yet another aspect of the invention, the sidewalls on the first tri-con container may be raised or lowered using a cable and reel disposed on either side of the sidewall. The reels may be coupled by a shaft such that both reels may be operated in synchronism from a drive mechanism disposed on one side of the tri-con container.

One embodiment of a structure 10 of this invention will now be described with respect to FIG. 1. A typical structure 10 comprises three tri-con containers, modules or units 20, 100 and 200. Units 20, 100 and 200, when joined together in a collapsed or closed condition, form a unitary, standard ISO shipping container having the dimensions of 8 feet high, 8 feet wide and 20 feet long. Units 20, 100 and 200, when linked together, may be shipped as a standard ISO shipping container to facilitate transport and storage. Each of units 20, 100 and 200 has a separate structure and function, as will be described.

In one aspect, unit 100 may be associated with at least one, and typically two softwalled, expandable shelters as will now be described with particular reference to FIGS. 2-8. Unit 100 includes four sidewalls 110, 112, 114 and 116. Unit 100 also may include a top wall 118, and a bottom wall 120. Sidewalls 110 and 112 are disposed directly opposite from one another, and are generally parallel to one another. Sidewalls 110 and 112 typically, although not necessarily, are aligned to face another one of units 20 and/or 200 when connected to units 20 and 200 to form structure 10.

Typically, unit 100 includes four corner posts 126. One corner post 126 is disposed at the junction of sidewalls 110 and 114, another post 126 is disposed at the junction of sidewalls 110 and 116, another post 126 is disposed at the junction of sidewalls 112 and 114, and another post 126 is disposed at the junction of sidewalls 112 and 116. These corner posts 126 are standard in such tri-con containers, and typically are formed with a square or rectangular cross-section to provide structural support for unit 100. Each corner post 126 is generally vertically oriented and extends from just below bottom wall 120 to just above top wall 118. Typically, horizontal structural supports 128 extend between the corner posts 126 both adjacent bottom wall 120, and adjacent top wall 118. Supports 128 and posts 126 are known and may be formed of any material, such as iron or steel or aluminum, which provides the necessary structural support for unit 100. Typically, structural support 128 adjacent bottom wall 120 is indented or spaced inwardly with respect to the outer edge of corner posts 126, providing a discontinuity between support 128 and the outer surface of corner posts 126. Each corner post 126 typically has a connection block 130 attached, such as by welding, to its top and bottom ends. Each connection block typically has holes 132 to allow a standard container connector (not shown) to be inserted therein. These connectors permit coupling of adjacent units 20, 100 and 200 together. Holes 132 also may be used for interfacing with a crane, forklift or other like mechanism for movement of units 20, 100 and 200 from one place to another. Conventional jacks 103 may be provided for leveling of unit 100. Jacks 103 may include pegs 105 that can be inserted into holes 102 in posts 126.

Figure 3:
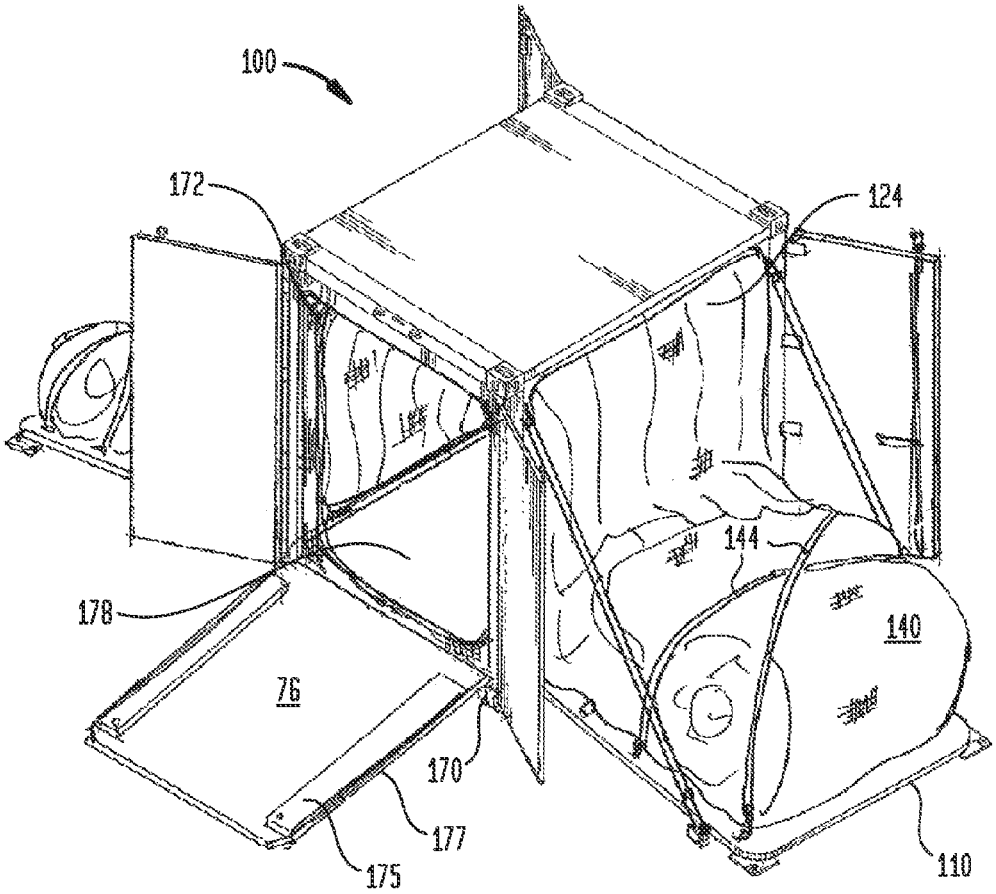
FIG. 3 is a front perspective view of the hard walled shelter container of FIG. 2 in a partially deployed condition.
Figure 4:
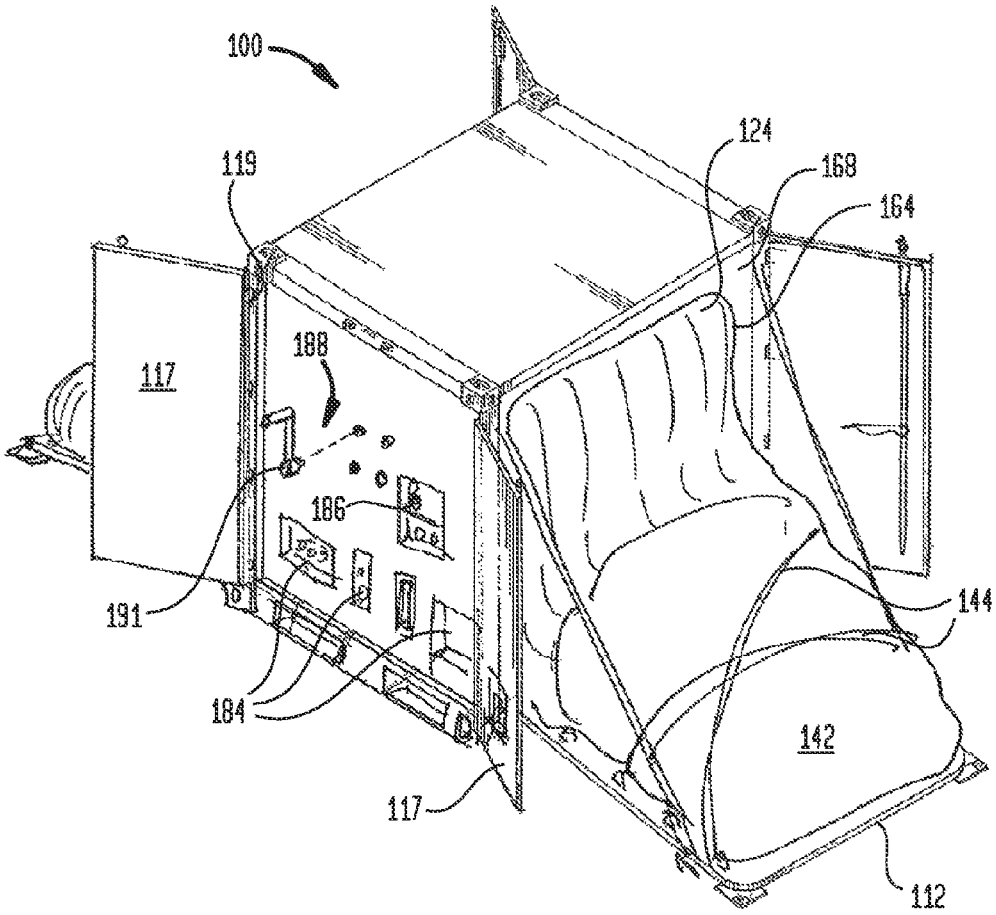
FIG. 4 is a rear perspective view of the hard walled shelter container of FIG. 2 in a partially deployed condition.

At least one of sidewalls 110 and 112, and typically both of sidewalls 110 and 112, are pivotally attached to a lower structural support 128 such as by hinges 122. Thus, at least one of sidewalls 110 and 112, and typically both of sidewalls 110 and 112, may be pivoted downwardly about hinges 122 to form a ramp as shown in FIGS. 3 and 4. In so doing, access to the interior of unit 100 is permitted through the opening 124 which results.

Associated with at least one of sidewalls 110 and 112, and typically both sidewalls 110 and 112, may be a softwalled, expandable shelter. In one embodiment, a first expandable shelter 140 is associated with sidewall 110, and a second expandable shelter 142 is associated with sidewall 112. Prior to deployment, each shelter 140 and 142 is folded and may be strapped or otherwise attached to associated sidewall 110 and 112, respectively. Straps 144 may be used to hold the folded shelters 140 and 142 in place on respective sidewalls 110 and 112. It should be appreciated that other known devices may be used in place of straps 144 to secure shelters 140 and 142 to walls 110 and 112. Other examples include ropes, wire, hook and loop fasteners, snaps and the like. Typically, although not necessarily, first shelter 140 may be attached at an upper end of sidewall 110 and second shelter 142 may be attached at a lower end of sidewall 112, so that shelter 140 is nested above shelter 142 when sidewalls 110 and 112 are pivoted into a closed or upright position. In this way, two relatively large, folded shelters may be accommodated in one unit 100.

Figure 9:
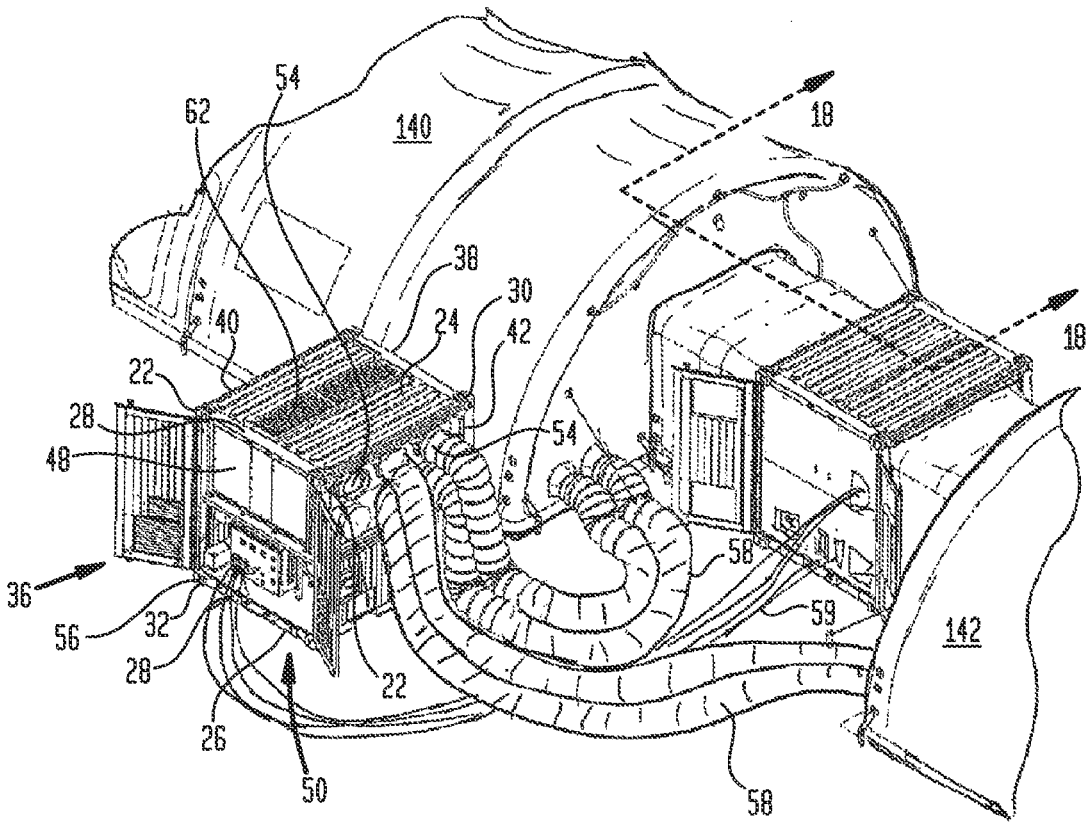
FIG. 9 is a fragmentary enlarged detailed view illustrating the mechanical tri-con container when connected to the hard walled shelter shown in FIG. 8.
Figure 10:
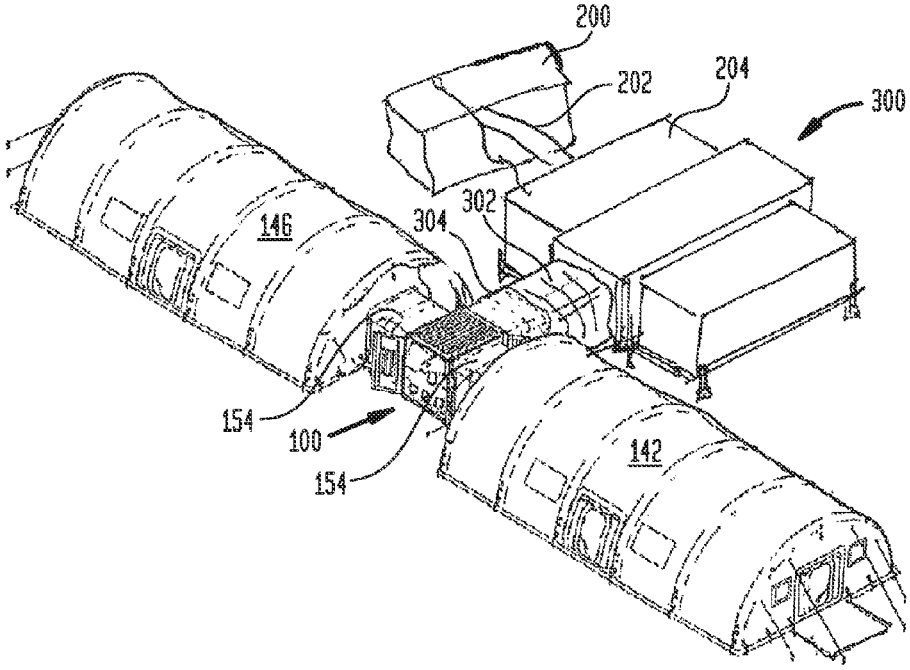
FIG. 10 is an isometric view of another configuration of the shelters of this invention when attached to the hard walled shelter of FIG. 4.
Figure 18:
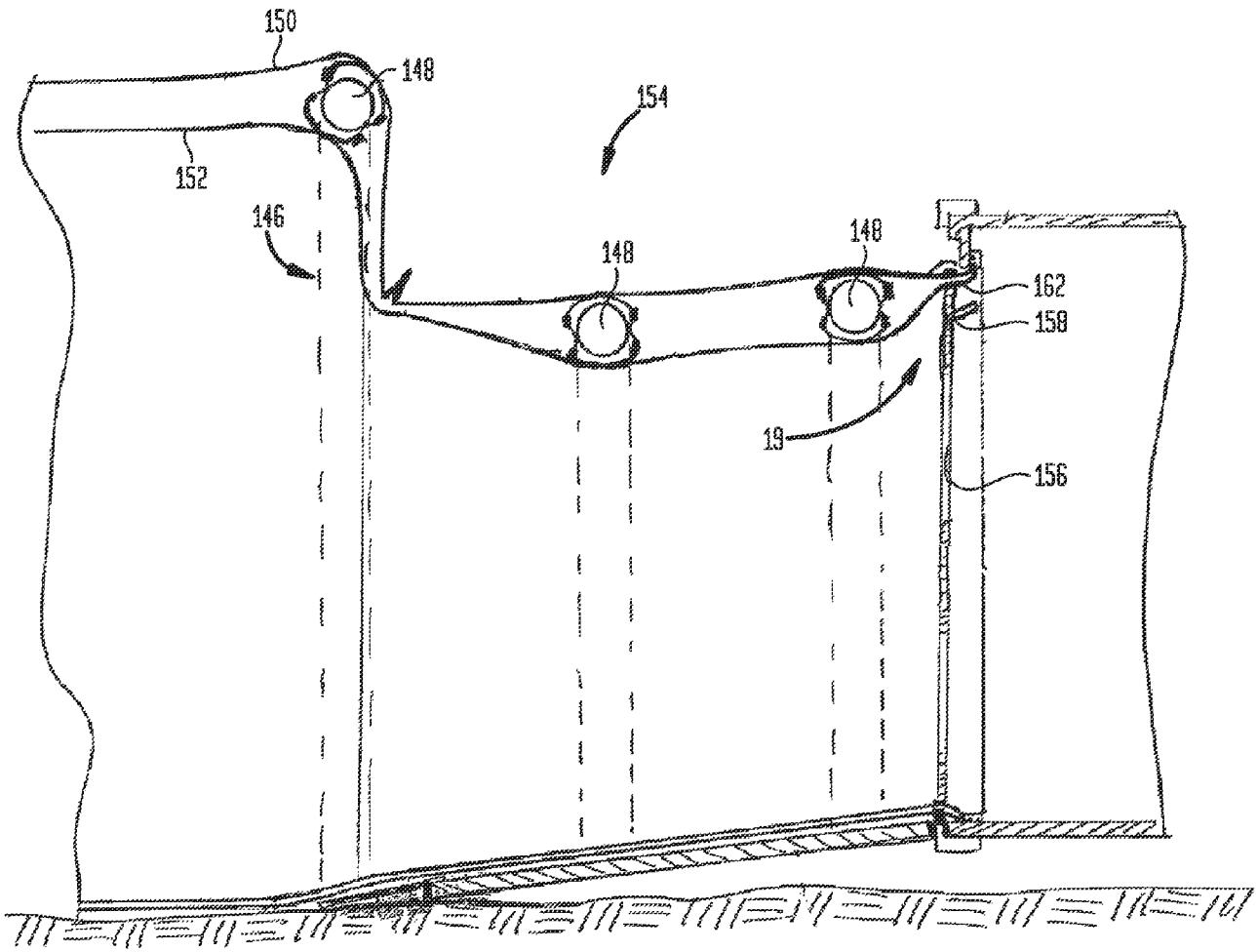
FIG. 18 is a schematic, cross-sectional view taken along the line 18-18 of FIG. 9.

As shown in FIG. 18, each of first and second expandable shelters 140 and 142 may be a conventional softwalled shelter comprising a beam structure 146 comprising air beams 148 over which a skin or environmental fabric layer 150 extends. The interior of shelters 140 and 142 also may include a chemical/biological barrier layer 152. Shelters 140 and 142 each typically include a transition vestibule 154 at one end (FIGS. 9 and 10). Vestibule 154 provides a transition from shelters 140 and 142 into the interior of unit 100. Vestibule 154 may include an opening 156 having an attachment device 158 extending around its perimeter for layer 150. This attachment device 158 may be a zipper, Velcro or any other conventional attachment device. Similarly, if shelters 140 and 142 include a chemical/biological barrier layer 152, layer 152 may include an attachment device 162 for just layer 152.

Figure 19:
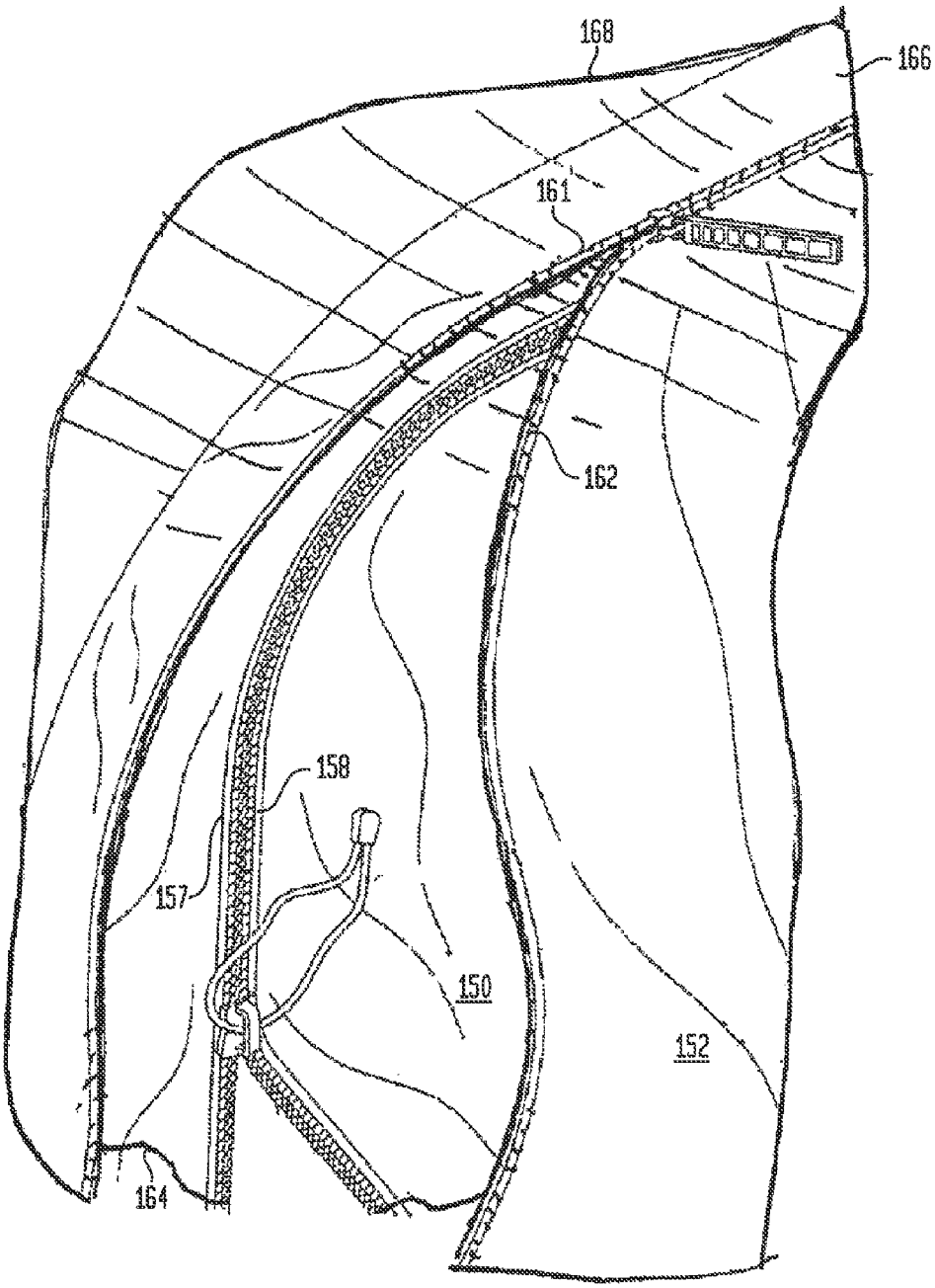
FIG. 19 is a partial, cutaway view of the environmental layer and the chemical/biological barrier layer as seen from inside the vestibule.
Figure 20:
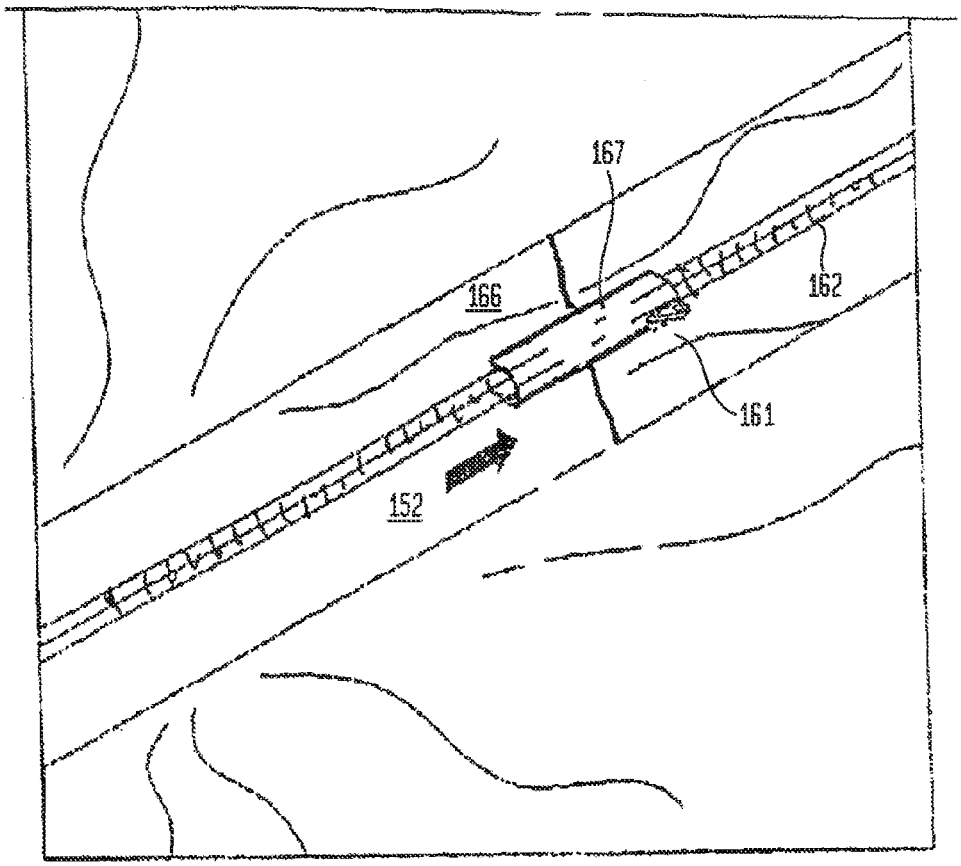
FIG. 20 is a partial cutaway view of the chemical/biological barrier layer in a fully sealed condition as seen from inside the vestibule.

In another aspect of the invention, opening 124 includes around its perimeter a coupling, such as a fabric clamp 168 containing at least one strip of an environmental fabric layer 164. There may also be a second strip of a chemical/biological barrier layer 166 in fabric clamp 168 (FIG. 19). The strips of layers 164 and 166 may be clamped together by clamp 168 along one edge. The opposite edges of strips of layers 164 and 166 are provided with respective attachment devices 157 and 161, such as a zipper, Velcro or the like which are designed to mate with associated, corresponding couplings, such as attachment devices 158 and 162 of vestibules 154 of shelters 140 and 142. In this way, once sidewalls 110 and 112 are pivoted downwardly to form a ramp, shelters 140 and 142 may be deployed and then subsequently coupled to unit 100 at openings 124. Strips of layer 164 are attached to layer 150 in shelters 140 and 142, by attachment devices 157 and 158, and strips of layer 166 are attached to layer 152 in shelters 140 and 142 by attachment devices 161 and 162 to form a sealed connection between unit 100 and vestibules 154 of shelters 140 and 142. A slidable sleeve 167 may be slid over the attachment device to cover the attachment device, such as a zipper, used to attach layer 166 to layer 152 to provide a tighter seal about the attachment device.

Figure 7:
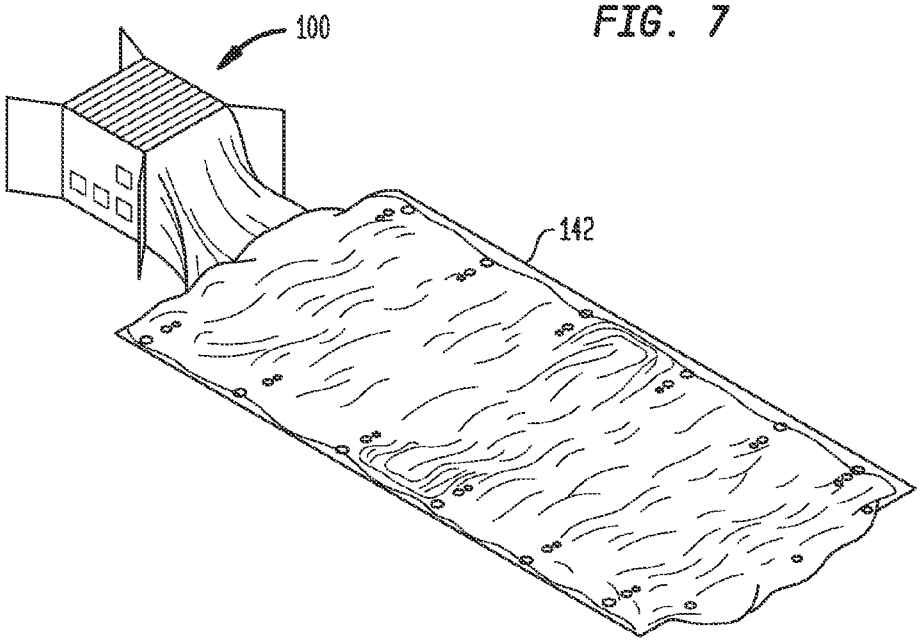
FIG. 7 is a perspective view of the hard walled shelter container of FIG. 4 showing the softwalled shelter in an unrolled condition.

In use, once it is decided to deploy shelters 140 and 142, sidewalls 110 and 112 are opened and pivoted downwardly to form ramps. Shelters 140 and 142 may then be removed from walls 110 and 112, respectively, by releasing straps 144. Shelters 140 and 142 may then be extended as shown in FIG. 7. Shelters 140 and 142 may then be expanded or inflated in a conventional way by first inflating the beam structure 146 and then anchoring the shelter to the ground in a manner well-known to those of ordinary skill in the art. Shelters 140 and 142 are attached to respective openings 124 of unit 100 as discussed above. When it is desired to deploy unit 100 elsewhere, air beam structure 146 may be deflated, and shelters 140 and 142 may then be rolled up and reattached to respective sidewalls 110 and 112 by straps 144. Thereafter, sidewalls 110 and 112 may be pivoted upwardly into a vertical position and locked.

In another aspect of the invention, sidewall 114 may include two doors 70 and 72 mounted on vertical hinges 74 on corner posts 126. Inside doors 70 and 72 may be a ramp 76 attached by hinges 170 to lower structural support 128 to permit ramp 76 to be pivoted from an upright or closed position to a downward position to expose opening 178. A coupling, such as fabric clamp 172, is similar to fabric clamp 168 and may extend around the perimeter of opening 178 in a manner similar to that of opening 124. Fabric clamp 172 may include first and second fabric layers affixed along one edge (not shown) similar to fabric clamp 168. Like fabric clamp 168, exposed, opposite edges of the fabric layers may include respective attachment devices (not shown), which may be zippers, Velcro strips or the like. These attachment devices are suitable for coupling with comparable attachment devices on another structure. Ramp 76 may include side ramp extenders 175 mounted on hinges 177. Once ramp 76 is pivoted downwardly, extenders 175 may be pivoted outwardly about hinges 177 to provide a wider ramp, if needed, to facilitate mating with another shelter.

One example of another shelter which may be affixed to opening 178 of unit 100, as shown in FIG. 10, is an expandable shelter 300, such as a hard walled shelter that expands from a collapsed shape having roughly the shape of a standard ISO container, to one which is approximately 3 times the size of an ISO container. An example of such a shelter 300 is described in U.S. Application No. 61/358,120 filed Jun. 24, 2010, which is incorporated herein by reference in its entirety. Shelter 300 may have a portico 302 or other like transition portion, which is attached to a vestibule 304 which in turn is attached to fabric clamp 172. Portico 302 and vestibule 304 each may include a chemical/biological layer and an environmental layer (not shown) with attachment devices (not shown) which mate with attachment devices on each other and on fabric clamp 172. In this way, another structure, such as shelter 300, may be attached to unit 100 allowing access to and from each of these shelters 300, 140 and 142 through unit 100.

It should be understood that shelter 300 need not be a one to three expandable ISO shelter, but could be any other suitable shelter that may be attachable to unit 100. For example, shelter 300 may be a non-expandable ISO container or a softwalled expandable shelter which has been suitably equipped for its desired use.

Figure 8:
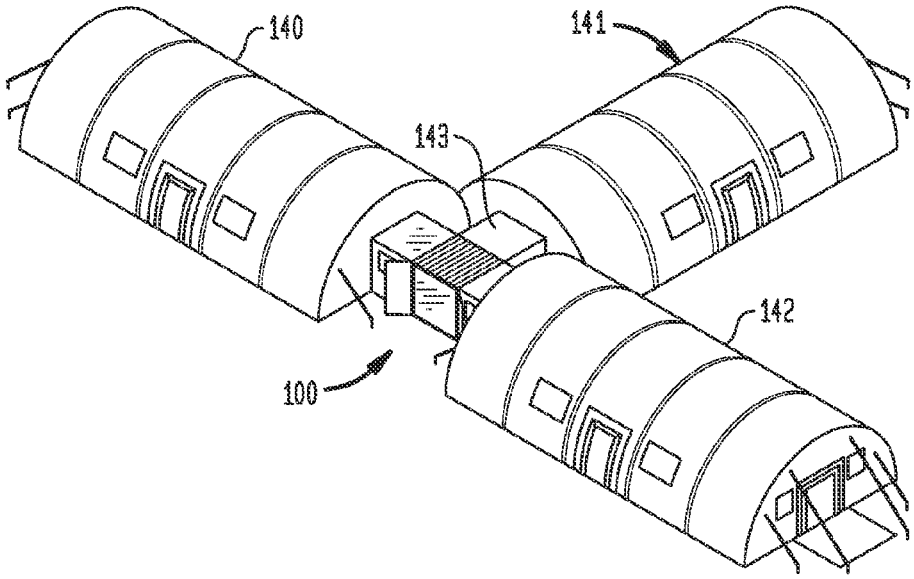
FIG. 8 is a perspective view of one configuration of the softwalled shelters of this invention when attached to the hard walled shelter of FIG. 4.
Figure 12:
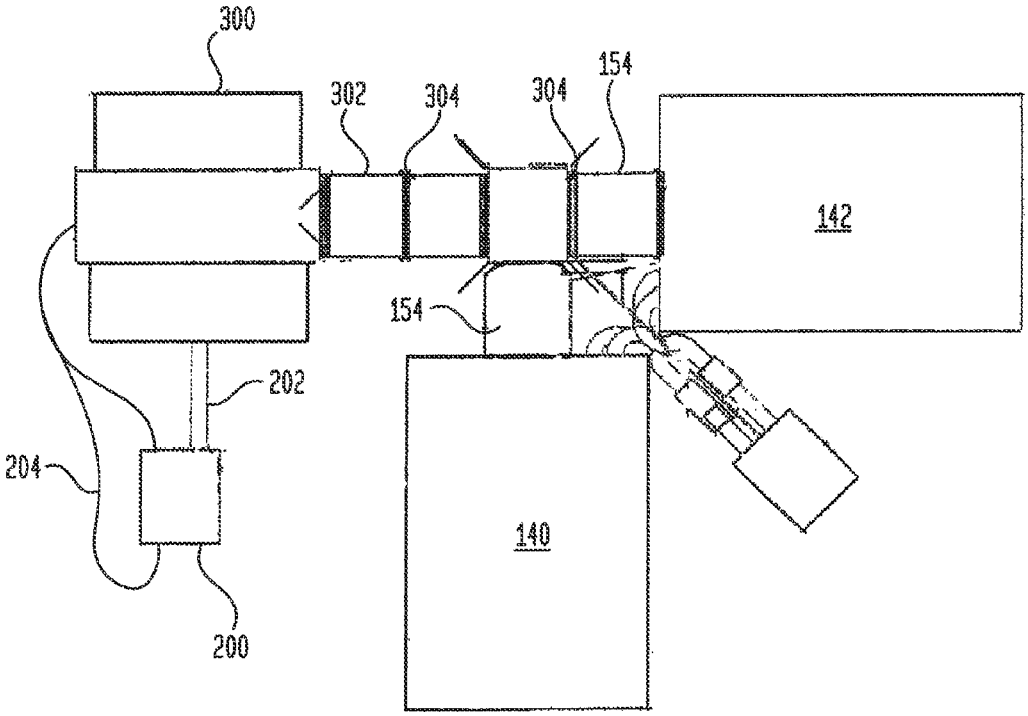
FIG. 12 is a schematic, plan view of yet another configuration of the shelters of this invention when connected to the hard walled shelter container of FIG. 4.
Figure 13:
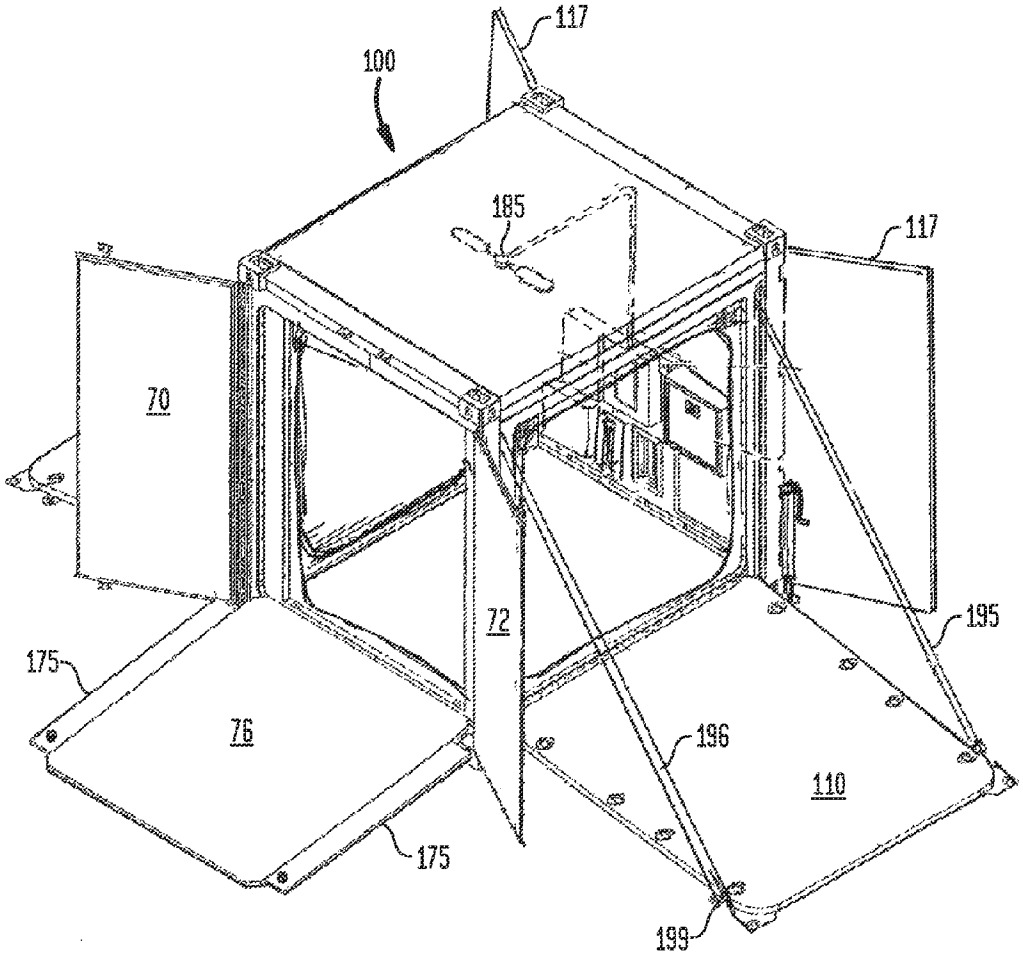
FIG. 13 is a front perspective view of the hard walled shelter container of FIG. 4.

FIGS. 8, 10 and 12 illustrate three possible configurations. It should be understood, that FIGS. 8, 10 and 12 are not exhaustive, and other configurations are possible. In FIG. 8, shelters 140 and 142 are shown extending from opposite sides of unit 100 at associated sidewalls 110 and 112 respectively. FIG. 8 illustrates another softwalled shelter 141 which may be similar or identical to shelters 140 and 142 and which is shown attached to unit 100 at ramp 76 and opening 178 by means of vestibule 143.

With reference now to FIG. 10, in another possible configuration, shelters 140 and 142 are shown attached to opposite sides of unit 100 as in FIG. 8. Instead of another softwalled shelter 141 as shown in FIG. 8, shelter 300 may be attached, as previously described, at ramp 76 and opening 178 of unit 100 utilizing portico 302 and vestibule 304.

In another possible configuration, as shown in FIG. 12, shelter 140 may be attached to unit 100 at opening 124 and sidewall 110, as described in FIG. 8. However, instead of shelter 142 being attached at opening 124 and sidewall 112, shelter 300 may be attached at sidewall 112. Shelter 300 is attached to unit 100 by means of portico 302 and vestibule 304 in substantially the same fashion as shown in FIG. 10. A softwalled shelter such as shelter 140 may be attached to unit 100 at ramp 76 and opening 178 in substantially the same fashion as shelter 140 is attached to unit 100 at opening 124 and sidewall 110. In this way, any desired configuration can be achieved depending on the needs and requirements of the user. It should be understood that there are other possible configurations, such as using only a single softwalled shelter, or no softwalled shelters, and instead employing multiple expandable hard walled shelters like shelter 300.

Figure 5:
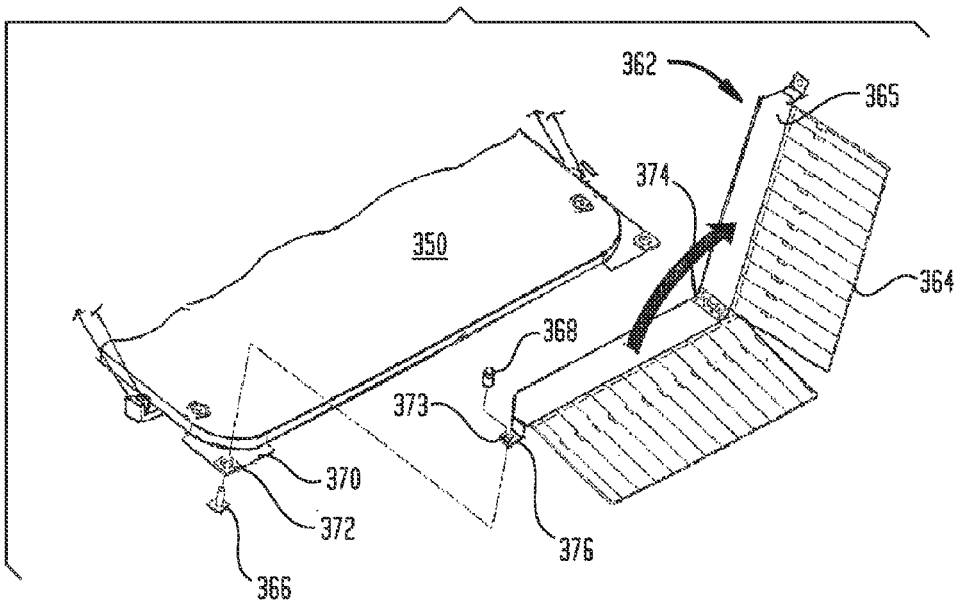
FIG. 5 is a fragmentary perspective view of the hard walled shelter container of FIG. 4 with a transition ramp.
Figure 6:
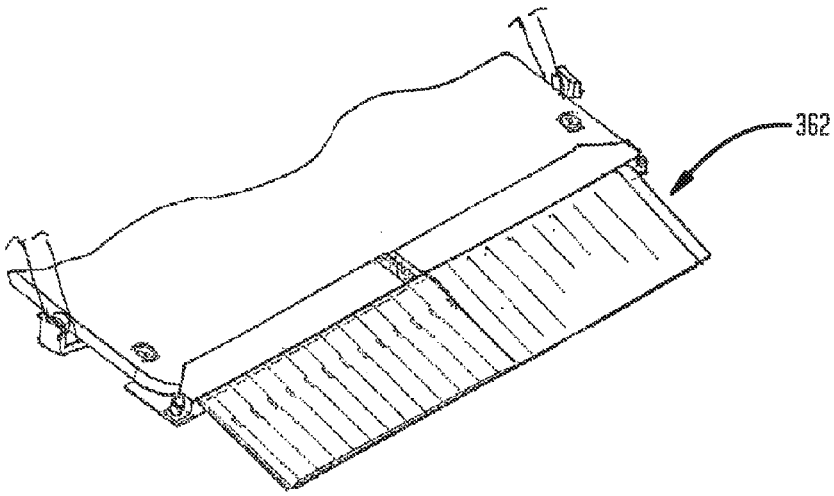
FIG. 6 is a fragmentary perspective view showing the transition ramp of FIG. 5 in an installed condition.
Figure 11:
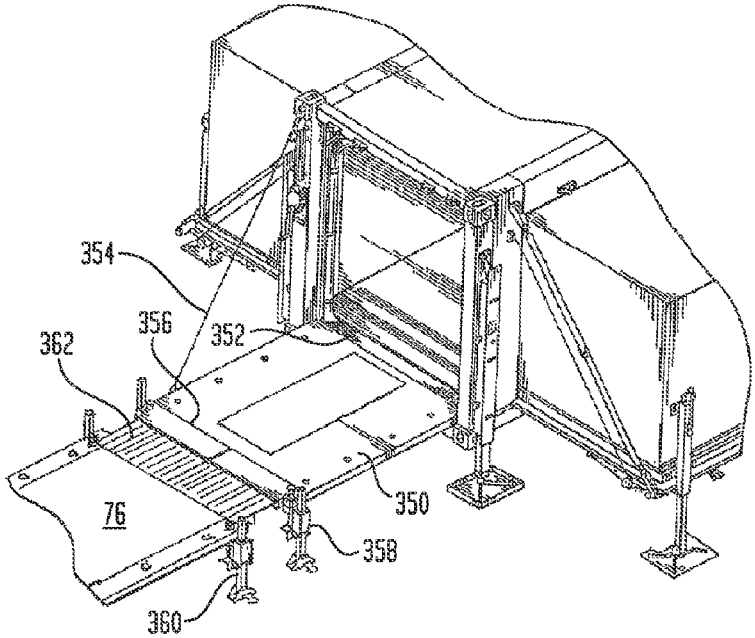
FIG. 11 is a fragmentary, perspective view showing the connection between the expandable ISO container of FIG. 10 and the hard walled shelter container of FIG. 4.

Another aspect of the invention, as shown in FIGS. 5, 6 and 11, relates to use of a hard walled shelter, such as expandable shelter 300 in conjunction with unit 100. A transition may be required between shelter 300 and unit 100 that will support portico 302 and vestibule 304 and the weight of cargo or humans. In one embodiment, shelter 300 includes a ramp 350 which may be pivoted downwardly to a substantially horizontal position. Ramp 350, in one embodiment, may form an endwall of shelter 300 when it is in a raised position. Ramp 350 may pivot about hinges 352 and be supported by cable 354. An end 356 of ramp 350 typically is supported by conventional jacks 358 having a ratchet mechanism. Ramp 350 is configured to support portico 302, Ramp 76, as shown in FIG. 11, may also be supported at its free end by jacks 360, which may be substantially identical to jacks 358 and may include a ratchet mechanism. Using jacks 358 and 360, ramps 76 and 350 may be positioned to be at the same level to provide a smooth transition from unit 100 to shelter 300.

To facilitate a transition between ramp 76 and ramp 350, it may be desirable to utilize a transition ramp 362. One example of transition ramp 362 is shown in FIGS. 5 and 6. Ramp 362 is substantially identical to the transition ramp described in U.S. Application No. 61/358,120 filed Jun. 24, 2010, which is incorporated herein by reference in its entirety. As shown in FIGS. 5 and 6, ramp 362 typically includes a plurality of fingers 364 which are pivotally mounted to a plate 365 by hinges. In one embodiment, plate 365 may include a hinge 374 at its middle to allow folding of ramp 362 when not in use. Fingers 364 typically are permitted to pivot upwardly or downwardly within a limited range, but are sufficiently rigid to accommodate a relatively heavy weight or load. Plate 365 may include at each end a bracket 376 with a hole 373. Typically, ramp 362 may be mounted onto the end of ramp 350 as shown in FIGS. 5 and 6. When mounted, bracket 376 sits on top of plate 370 so that a hole 372 in plate 370 is aligned with hole 373 in bracket 376. Pin 366 may be inserted through the aligned holes and held in place with a locking sleeve 368. Transition ramp 362 may provide a transition between ramp 350 and ramp 76, as shown in FIG. 11. Ramp 362 may also provide a transition between ramp 350 and an underlying ground surface, as shown in FIG. 6.

As seen in FIG. 4, sidewall 116 may include two doors 117 which are affixed by vertical hinges 119 to posts 126. Inside doors 117 may be a panel 21 that may include power ports 186 and ports 184 used for various purposes that include, but are not limited to supplying control cables, supplying water, removing waste, and supplying medical gases. Power may be provided to lights 185 by means of power ports 186. Sidewall 116 also may include two drive mechanisms 188 for raising and lowering sidewalls 110 and 112, as discussed below.

At least one of walls 110 and 112, and, in one embodiment, each of walls 110 and 112, may be raised or lowered using a drive mechanism 188, as shown in FIGS. 14, 15, 16 and 17. Sidewall 112 is shown being lowered in FIG. 14 utilizing socket 386, and is shown being raised in Fig, 15, utilizing socket 385. The drive mechanism 188 used to raise and lower sidewall 110 is substantially identical to that used to raise and lower sidewall 112 and this drive mechanism will be described only with respect to sidewall 112.

Cables 195 and 196 may be disposed on opposite sides of each wall 110 and 112. Each of cables 195 and 196 may be anchored at anchor 197 and 198, respectively, each of which typically is disposed on an associated corner post 126. Associated with another end of each of cables 195 and 196 is a spool 193 and 194, respectively, onto which respective cables 195 and 196 may be wound after passing over respective pulleys 201 and 203 on associated corner posts 126. Spools 193 and 194 may be mounted on a shaft 192 that spans the width of unit 100. In this manner, spools 193 and 194 may be rotated in synchronism to allow wall 110 or 112 to be raised evenly on each side by raising each side at the same rate and the same distance. Cables 195 and 196 may pass over pulleys 199 disposed on walls 110 and 112.

Figure 14:
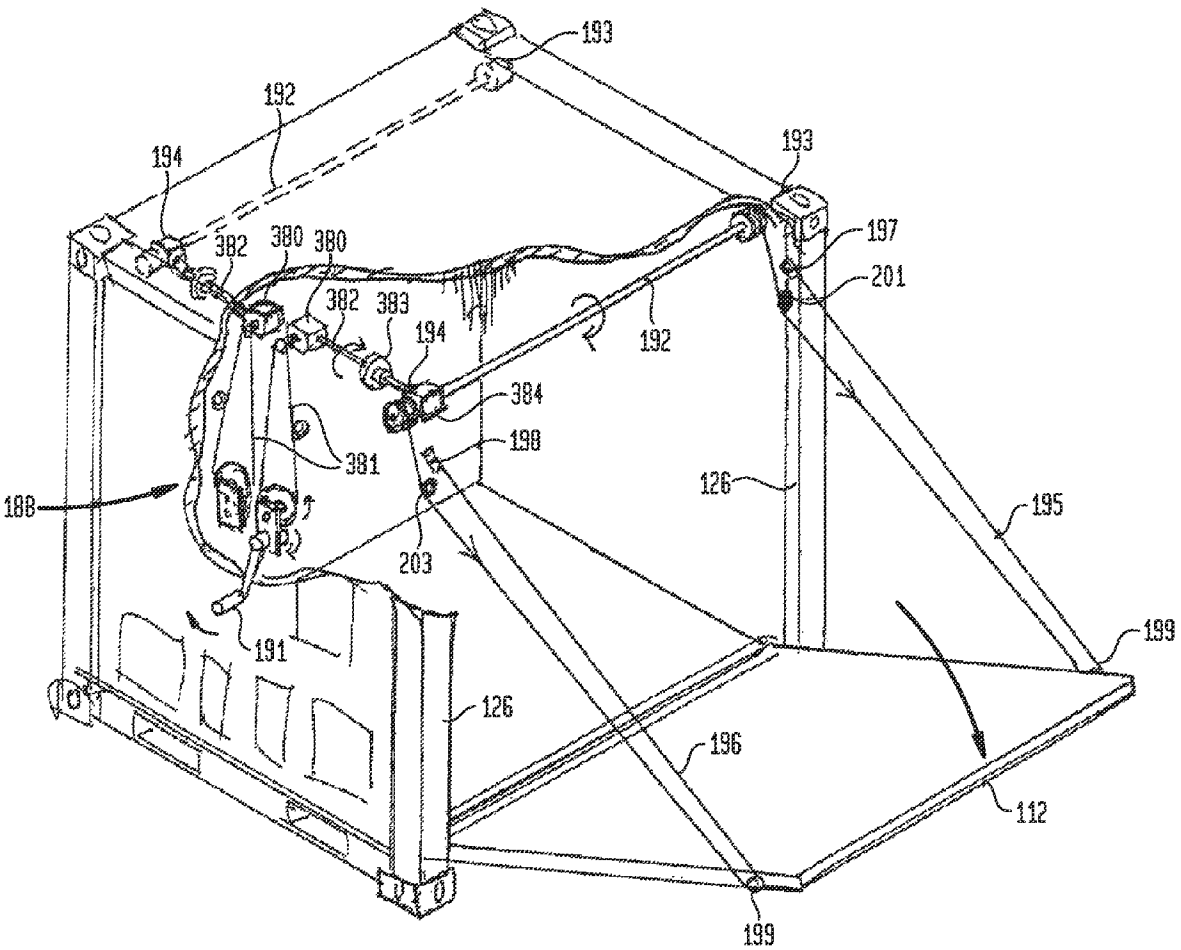
FIG. 14 is a schematic, rear perspective view of the hard walled shelter container of FIG. 4 illustrating the mechanism for operating the ramps.
Figure 15:
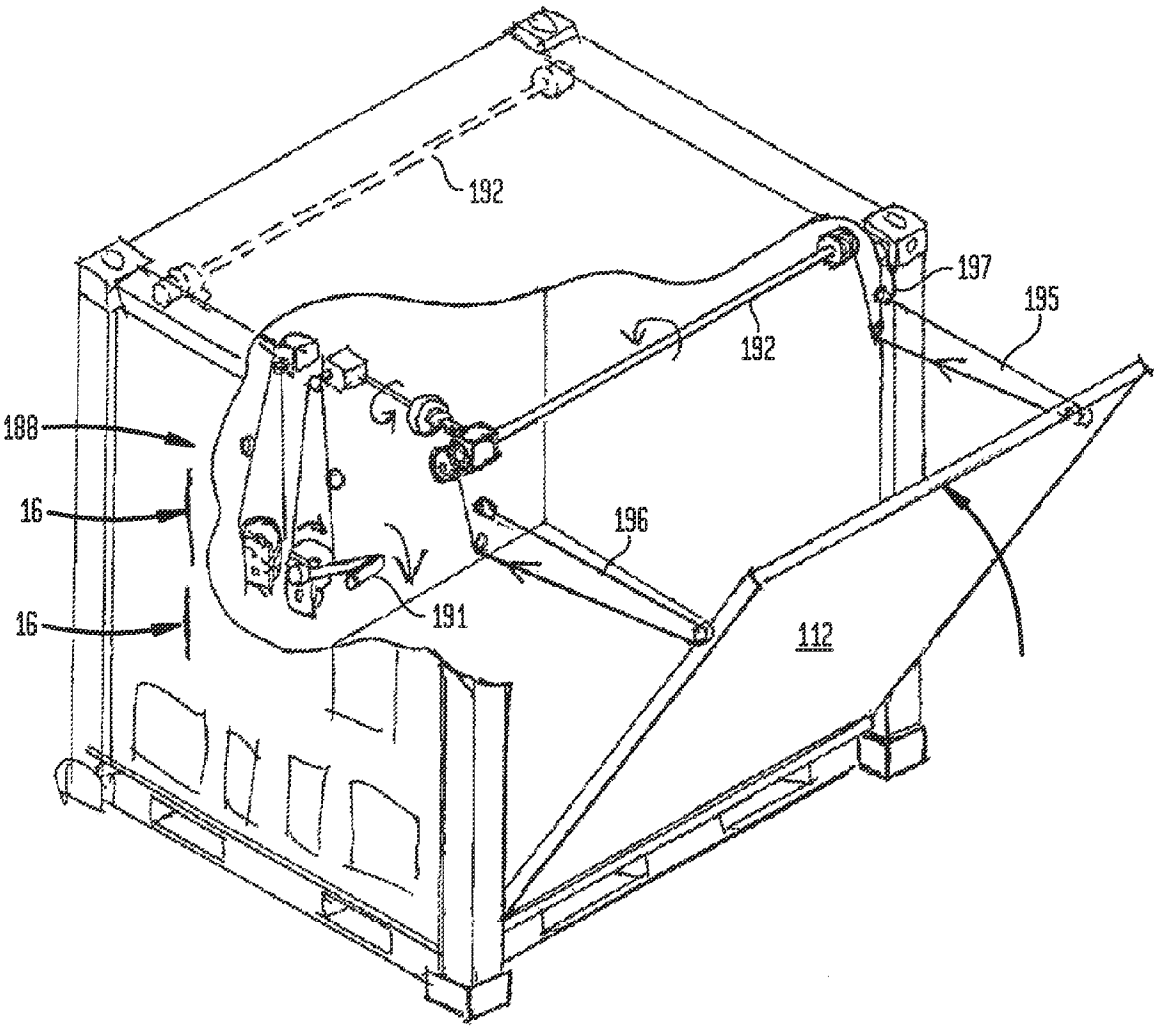
FIG. 15 is a schematic, rear perspective view of the hard walled shelter container of FIG. 14 showing a ramp being raised.

Drive mechanism 188 may be coupled to shaft 192. Typically, a separate, nearly identical drive mechanism 188 is associated with each of sidewalls 110 and 112. As shown in FIGS. 14 and 15, with reference to sidewall 112, mechanism 188 may be coupled to a right angle drive 380 by a chain 381. Right angle drive 380 may be coupled to a shaft 382 which rotates in response to mechanism 188. Shaft 382 may be connected to a torque limiter (for example 58 pounds) 383 which then may pass through a gear reducer 384 which may then be coupled to shaft 192 for rotation of spools 193 and 194. It is understood that the foregoing drive train is substantially identical for sidewall 110.

Figure 17:
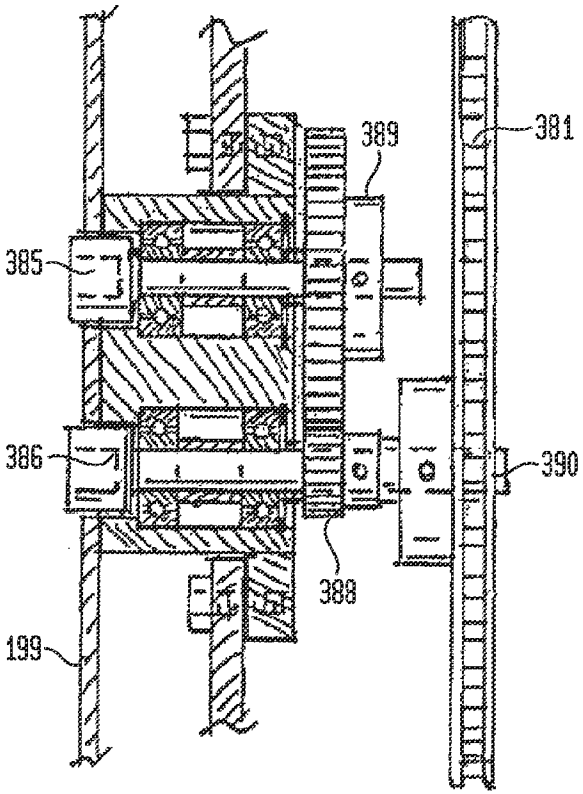
FIG. 17 is a cross-sectional view of the mechanism for operating the ramps taken along the line 17-17 of FIG. 16.
Figure 16:
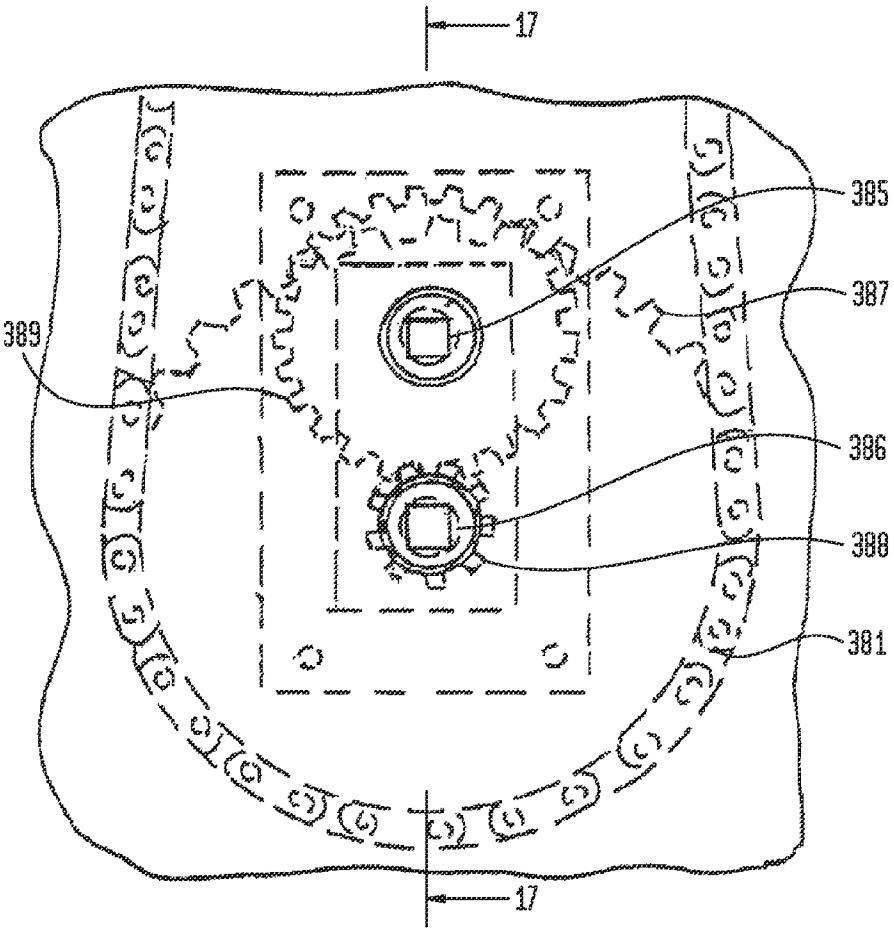
FIG. 16 is a front, cross-sectional view of the mechanisms for operating the ramps taken along line 16-16 of FIG. 15.

Each mechanism 188 will now be described with particular reference to FIGS. 16 and 17. Two separate sockets may be provided, a first up socket 385 for raising a sidewall 110 or 112, and a second down socket 386 for lowering a sidewall 110 or 112. In one embodiment, socket 385 provides a greater mechanical advantage than socket 386. Either socket may be used in conjunction with a rotating device such as a handle 191 for manual operation, or either socket may be used in conjunction with a motor driven drill or the like (not shown), which includes a drill bit suitable for mating with sockets 385 and 386. Socket 385 may be coupled to a spur gear 389 which, in one embodiment, has 60 teeth. Spur gear 389 may drive spur gear 388, which in one embodiment, may have 16 teeth. Socket 386 is directly coupled to spur gear 388. Spur gear 388, in turn, may be coupled to a shaft 390, which is directly coupled to a sprocket 387 which drives chain 381. In this embodiment, when socket 385 is used to raise a sidewall 110 or 112, approximately a 4 to 1 ratio results from the interaction of spur gear 389 with spur gear 388 which allows sidewall 110 or 112 to be raised slowly with a relatively large mechanical advantage. However, when door 110 or 112 is lowered, socket 386 is used and because socket 386 is directly coupled to gear 388, sidewall 110 or 112 may be lowered under its own weight at a much more rapid pace than when sidewall 110 or 112 was raised. In this embodiment, spur gear 389 is allowed to free-wheel when sidewall 110 or 112 is lowered.

Units 20 and 200 may have multiple applications. For example, unit 20 may be a mechanical module which provides electrical and environmental support for unit 100 and/or shelters 140 and 142 and/or shelter 300. One example is shown in FIG. 9. Like unit 100, unit 20 may include four corner posts 22 which are interconnected by horizontal supports 28. Unit 20 may also include a top wall 24 and a bottom wall 26. Connection blocks 30 may be disposed at the top and bottom of posts 22. These blocks may include holes 32 for use with connectors (not shown) to couple units 20, 100 and 200 together, or to allow unit 20 to be hoisted or moved by a crane or the like. Unit 20 also may include sidewalls 36, 38, 40 and 42. In one embodiment, walls 36 may be formed as doors 36*a* and 36*b*. Doors 36*a* and 36*b*, typically are mounted on adjacent posts 22, such as by hinges 37, allowing them to be pivoted into an open position or into a closed position. Doors 36*a* and 36*b* allow access to the interior of unit 20 for servicing, storage and the like.

When unit 20 includes electrical and environmental support for unit 100 and/or shelters 140 and 142, unit 20 may include a heating and air conditioning system 48 and a power unit 50. In one embodiment, the heating and air conditioning system 48 is suitable for providing environmental support for shelters 140 and 142, has a cooling capacity of about 10 tons and has a heating capacity of about 22 kilowatts. Filter beds may be included, along with a humidity control and a switchable fresh air source. Unit 50, in one example, can be a 40-killowat on-board generator. Duct interfaces 54 may be provided along sidewall 40 at opening 46. Duct interfaces may be connected to ducts in shelters 140 and 142 such as by duct work 58 to provide air flow to and from shelters 140 and 142. Power unit 50 may be coupled to a power connection 56 which in turn can be coupled to power connector 186 on unit 100 and to shelters 140 and 142 by wires 59. A fuel tank (not shown) may be included for providing fuel to the power unit 50. One example is a 80-gallon fuel tank for any suitable fuel, such as diesel or jet fuel. Cooling fans 62 may also be provided for ventilation of unit 20. These fans typically are provided in openings in top wall 24.

Unit 200 has the same conventional tri-con structure as units 20 and 100. Unit 200 may be used in one of several different ways. In one embodiment, unit 200 serves as a storage facility for containing gear used in conjunction with shelters 140, 142 or shelter 300. In another embodiment, when structure 10 is used in conjunction with a shelter 300, unit 200 may contain apparatus that provides the heating and air conditioning support and electrical power support for shelter 300. As shown in FIGS. 10 and 12, for example, unit 200 may be coupled to shelter 300 by duct work 202 for heating and air conditioning support, and by cables 204 for supplying electrical power to shelter 300. In all other significant respects, when unit 200 provides mechanical and electrical power support for shelter 300, it is substantially identical to unit 20, and will not be further described.

In another aspect, certain conventional handling devices used to move tri-cons or ISO containers from one place to another grip the container at the bottom end of post 126 utilizing holes 132 in connection blocks 130. An example is the U.S. Military Future Medium Tactical Vehicle with Load Handling Systems (FMTV-LHS). These mechanized devices typically have arms that ride along lower structural supports 128 until arriving at connection block 130. Conventional tri-con structures, as presently built, may not be manipulated by these devices, because the device hangs up at the intersection of surface 250 along structural support 128 and a surface on post 126 which is disposed at right angles to surface 250. This problem may be solved with respect to each of units 20, 100 and 200 by the provision of an adapter 254 which extends from surface 250 to the outside facing surface of post 126. The outer surface of adapter 254 may be generally flush with the outer surface of the outside facing surface of post 126 and connection block 130 such that there is a smooth transition from surface to surface. Similarly, the outer surface of adapter 254 transitions smoothly to the outer surface 250 on support 128 creating a ramp between the outside facing surface of post 126 and surface 250. As a result, the handling device (not shown) can ride along surface 250 and then along the outer surface of adapter 254 and onto the outer facing surface of post 126 where it can extend into a hole 132 on connection block 130. The lifting device may be spring-loaded or biased inwardly toward support 128 to facilitate this movement.

It should be appreciated that various embodiments may be formed with one or more of the above-described features. The above aspects and features may be employed in any suitable combination as the present invention is not limited in this respect. It should also be appreciated that the drawings illustrate various components and features which may be incorporated into various embodiments. For simplification, some of the drawings may illustrate more than one optional feature of the feature or component. However, the invention is not limited to the specific embodiments disclosed in the drawings. It should be recognized that the invention encompasses embodiments which may include only a portion of the components illustrated in any one drawing figure, and/or may also encompass embodiments combining components illustrated in multiple different drawing figures.

It should be understood that the foregoing description of various embodiments is intended merely to be illustrative thereof and that other embodiments, modifications, and equivalents are within the scope of the invention recited in the claims appended hereto.

What is claimed is:

1. A container unit capable of being coupled to at least one additional container unit to form an intermodal container having the approximate dimensions of a standard ISO container, the intermodal container is capable of being handled by a medium tactical vehicle with a load handling system, the container unit comprising:

first and second substantially parallel corner posts;

an upper frame support extending between first ends of the corner posts;

a lower frame support extending between second ends of the corner posts;

first and second connection blocks each disposed adjacent the second ends of the corner posts such that an outer face of each of the connection blocks are offset from an outer face of the lower frame support; and first and second adapter plates each disposed adjacent one of the connection blocks, a proximal end of the adapter plate being connected to the connection block and being positioned generally flush with an outer facing surface of the connection block, and a distal end of the adapter being angled to connect to an outer surface of the lower frame support so as to provide a transition ramp between the outer facing surface of the connection block and the outer surface of the lower frame support.

2. The container unit of claim 1, wherein the adapter plates provide a continuous transition between the outer facing surface of the connection block and the outer surface of the lower frame support when the medium tactical vehicle load handling system interfaces with the first and second connection blocks.

3. The container unit of claim 1, wherein the adapter plates have a height that is equal to the height of the lower frame support.

4. A container unit capable of being coupled to at least one additional container unit to form an intermodal container having the approximate dimensions of a standard ISO container, the intermodal container is capable of being handled by a medium tactical vehicle with a load handling system, the container unit comprising first and second substantially parallel corner posts, an upper frame support extending between first ends of the corner posts, a lower frame support extending between second ends of the corner posts, a connection block disposed adjacent to each of the second ends of the corner posts such that an outer face of each of the connection blocks are offset from an outer face of the lower frame support, and an adapter plate wherein a proximal end of the adapter plate connects to an outer surface of the connection block and a distal end of the adapter plate slopes inward towards the lower frame support to connect to an outer surface of the lower frame support so as to provide a transition ramp between the outer facing surface of the connection block and the outer surface of the lower frame support.

5. The adapter plate of claim 4, wherein the adapter plate provides a continuous transition between the outer surface of the connection block and the outer surface of the lower frame support when the medium tactical vehicle load handling system interfaces with the connection block.

6. The adapter plate of claim 4, wherein the adapter plate has a height that is equal to the height of the lower frame support.

7. The container unit of claim 4, wherein the adapter plate is disposed adjacent to the connection block.

8. The container unit of claim 4, wherein the adapter plate is positioned generally flush with an outer facing surface of the connection block.

9. The container unit of claim 4, wherein the adapter plate is angled from the outer surface of the connection block towards the outer surface of the lower frame support.

10. The container unit of claim 9, wherein angle between the outer surface of the adapter plate and the outer surface of the lower frame support is obtuse.

11. The container unit of claim 4, wherein the adapter plate creates a ramp between the outer surface of the connection block and the outer surface of the lower frame support.

12. A container unit capable of being coupled to at least one additional container unit to form an intermodal container having the approximate dimensions of a standard ISO container, the intermodal container is capable of being handled by a medium tactical vehicle with a load handling system, the container unit comprising:

two substantially parallel corner posts;

an upper frame support extending between first ends of the corner posts;

a lower frame support extending between second ends of the corner posts;

a connection block disposed adjacent to one of the corner posts such that an outer face of each of the connection block and an outer face of the lower frame support are not coplanar, and an adapter wherein a first end of the adapter connects to an outer surface of the connection block and a second end of the adapter connects to an outer surface of the lower frame support creating a ramp between the connection block and the lower frame support.

13. The adapter of claim 12, wherein the adapter provides a continuous transition between the outer facing surface of the connection block and the outer surface of the lower frame support when the medium tactical vehicle load handling system interfaces with the connection block.

14. The adapter of claim 12, wherein the adapter has a height that is equal to the height of the lower frame support.

15. The container unit of claim 12, wherein the adapter is disposed adjacent to the connection block.

16. The container unit of claim 12, wherein the adapter is positioned generally flush with an outer facing surface of the connection block.

17. The container unit of claim 12, wherein the adapter creates a ramp between the outer facing surface of the connection block and the outer facing surface of the lower frame support.

* * * * *